US009911320B2

(12) United States Patent
Franz et al.

(10) Patent No.: US 9,911,320 B2
(45) Date of Patent: Mar. 6, 2018

(54) REMOTE CONTROL SYSTEM

(71) Applicant: Vermeer Manufacturing Company, Pella, IA (US)

(72) Inventors: Robert Franz, Independence, IA (US); Matthew Stringer, Archbold, OH (US); Thomas Haley, Pella, IA (US); Ty Hartwick, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 157 days.

(21) Appl. No.: 14/449,753

(22) Filed: Aug. 1, 2014

(65) Prior Publication Data

US 2015/0035656 A1 Feb. 5, 2015

Related U.S. Application Data

(60) Provisional application No. 61/861,759, filed on Aug. 2, 2013.

(51) Int. Cl.

| | |
|---|---|
| ***G08C 17/02*** | (2006.01) |
| ***G08C 19/00*** | (2006.01) |
| ***G08C 23/04*** | (2006.01) |

(52) U.S. Cl.

CPC ..... *G08C 17/02* (2013.01); *G08C 19/00* (2013.01); *G08C 23/04* (2013.01); *G08C 2201/30* (2013.01); *G08C 2201/91* (2013.01)

(58) Field of Classification Search

CPC .... G08C 17/02; G08C 19/00; G08C 2201/30; G08C 2201/91; G08C 23/04

USPC ..... 340/12.5

See application file for complete search history.

(56) References Cited

U.S. PATENT DOCUMENTS

| | | | | |
|---|---|---|---|---|
| 3,381,922 | A | 5/1968 | Laing | |
| 3,618,420 | A | 11/1971 | Horwitt et al. | |
| 3,768,367 | A | 10/1973 | Fuzzell | |
| 4,361,836 | A | 11/1982 | Zettergren | |
| 4,825,209 | A | 4/1989 | Sasaki et al. | |
| 4,906,972 | A | 3/1990 | Spencer | |
| 5,198,800 | A | 3/1993 | Tozawa et al. | |
| 5,350,986 | A * | 9/1994 | Long | E05F 15/632 318/266 |
| 5,477,210 | A | 12/1995 | Belcher | |
| 5,619,412 | A * | 4/1997 | Hapka | B60R 25/04 123/179.2 |

(Continued)

FOREIGN PATENT DOCUMENTS

| | | |
|---|---|---|
| BE | 1011838 A6 | 2/2000 |
| CN | 2280030 Y | 4/1998 |

(Continued)

OTHER PUBLICATIONS

European Search Report for Application No. 14179678 dated Dec. 15, 2014.

*Primary Examiner* — Yong Hang Jiang
(74) *Attorney, Agent, or Firm* — Merchant & Gould P.C.

(57) ABSTRACT

A remote control system includes a control unit configured to send a control signal to a machine to be controlled from a position remote from the machine. A sensor system is operatively linked with the control unit, and is configured for registering a presence of an operator in a predetermined proximity to a predetermined location. Operation of the machine to be controlled is responsive to the sensor system.

17 Claims, 3 Drawing Sheets

(56) References Cited

U.S. PATENT DOCUMENTS

| | | | | |
|---|---|---|---|---|
| 5,878,156 | A * | 3/1999 | Okumura | G08B 21/06 340/575 |
| 5,939,986 | A | 8/1999 | Schiffbauer et al. | |
| 5,964,313 | A | 10/1999 | Guy | |
| 6,028,537 | A | 2/2000 | Suman et al. | |
| 6,112,139 | A * | 8/2000 | Schubert | E02F 3/847 172/4.5 |
| 6,208,260 | B1 | 3/2001 | West et al. | |
| 6,647,328 | B2 | 11/2003 | Walker | |
| 6,810,353 | B2 | 10/2004 | Schiffbauer | |
| 6,834,219 | B2 | 12/2004 | Proulx | |
| 6,871,712 | B2 | 3/2005 | Koch et al. | |
| 6,894,610 | B2 | 5/2005 | Schubert et al. | |
| 6,917,837 | B2 | 7/2005 | Hashimoto et al. | |
| 6,923,285 | B1 | 8/2005 | Rossow et al. | |
| 7,088,284 | B2 | 8/2006 | Young | |
| 7,301,441 | B2 | 11/2007 | Inada et al. | |
| 7,420,471 | B2 | 9/2008 | Frederick et al. | |
| 7,796,021 | B2 | 9/2010 | Saban | |
| 7,836,672 | B2 | 11/2010 | Link et al. | |
| 7,890,235 | B2 * | 2/2011 | Self | G01S 3/143 340/539.1 |
| 8,051,936 | B1 | 11/2011 | Hebert et al. | |
| 8,115,650 | B2 | 2/2012 | Dasilva et al. | |
| 8,195,344 | B2 | 6/2012 | Song et al. | |
| 8,195,366 | B2 | 6/2012 | McCabe et al. | |
| 8,232,888 | B2 | 7/2012 | Frederick et al. | |
| 8,289,170 | B2 | 10/2012 | Pryor et al. | |
| 8,301,318 | B2 | 10/2012 | Lacaze et al. | |
| 8,346,432 | B2 | 1/2013 | Van Wiemeersch et al. | |
| 8,362,873 | B2 | 1/2013 | Miller et al. | |
| 2001/0056544 | A1 | 12/2001 | Walker | |
| 2003/0161906 | A1 | 8/2003 | Braunhardt et al. | |
| 2004/0222913 | A1 | 11/2004 | Olmsted et al. | |
| 2006/0052144 | A1 * | 3/2006 | Seil | H04B 1/3822 455/575.1 |
| 2006/0273917 | A1 * | 12/2006 | Rams, Jr. | B60N 2/002 340/667 |
| 2007/0137904 | A1 | 6/2007 | Rose et al. | |
| 2008/0208395 | A1 | 8/2008 | Self et al. | |
| 2009/0158624 | A1 | 6/2009 | Hartwick | |
| 2009/0326734 | A1 | 12/2009 | Gudat | |
| 2010/0175014 | A1 | 7/2010 | Obradovich | |
| 2011/0133929 | A1 | 6/2011 | Eitle et al. | |
| 2012/0004791 | A1 | 1/2012 | Buelthoff et al. | |
| 2012/0280520 | A1 * | 11/2012 | Wellborn, Sr. | B60N 2/466 292/336.3 |
| 2012/0286927 | A1 | 11/2012 | Hagl | |

FOREIGN PATENT DOCUMENTS

| | | | |
|---|---|---|---|
| EP | 0 027 435 | A1 | 4/1981 |
| EP | 1 004 230 | A2 | 5/2000 |
| EP | 1 332 658 | A1 | 8/2003 |
| EP | 1 834 921 | A2 | 9/2007 |
| EP | 2 020 626 | A1 | 2/2009 |
| EP | 1 332 658 | B2 | 5/2011 |
| GB | 1092849 | A | 11/1967 |
| JP | 8-33238 | A | 2/1996 |
| JP | 3128433 | B2 | 1/2001 |
| WO | WO 2009/055606 | A1 | 4/2009 |

* cited by examiner

REMOTE CONTROL SYSTEM

CROSS-REFERENCE TO RELATED APPLICATION

This application claims the benefit of U.S. Provisional Patent Application No. 61/861,759, which is incorporated by reference in its entirety.

BACKGROUND

The present disclosure relates generally to remote control systems.

In some circumstances it can be desirable to remotely control machines or implements powered by such machines. For example, certain self-propelled machines are sometimes used in situations where there is a need for an operator to control the machine from a position remote from the machine.

Improvements in remote control systems are desired.

SUMMARY

In accordance with aspects of the present disclosure, a remote control system includes a control unit configured to send a control signal to a machine to be controlled from a position remote from the machine. A sensor system is operatively linked with the control unit, and is configured for registering a presence of an operator in a predetermined proximity to a predetermined location. Operation of the machine to be controlled is responsive to the sensor system. For example, if the presence of the operator in the predetermined proximity to a predetermined location is not registered by the sensor system, remote operation of the machine can be limited or completely disabled.

In accordance with other aspects of the disclosure, a remote control system includes a control unit configured to send a control signal to a machine to be controlled from a position remote from the machine, and sensor system operatively linked with the control unit that is configured for registering a presence of at least one of an operator and the control unit in a predetermined location. Operation of the machine by the control unit is limited in response to the sensor system.

For example, the predetermined location could be a location that is a predetermined distance from the machine to be controlled. In some examples, the predetermined location includes an enclosure, such as the cab of a vehicle.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as top, bottom, front, back, etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense.

Figure 1:
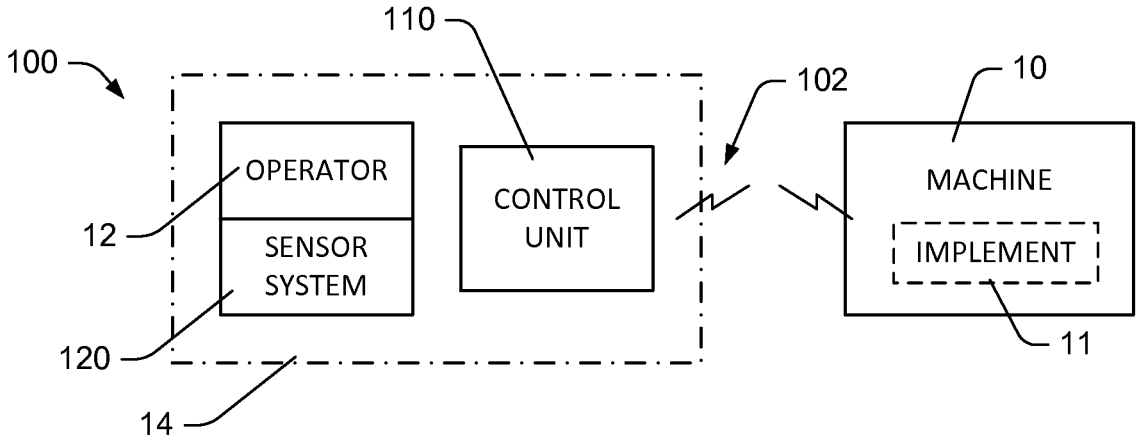
FIG. 1 is a block diagram illustrating an example of a remote control system in accordance with aspects of the present disclosure.
Figure 2:
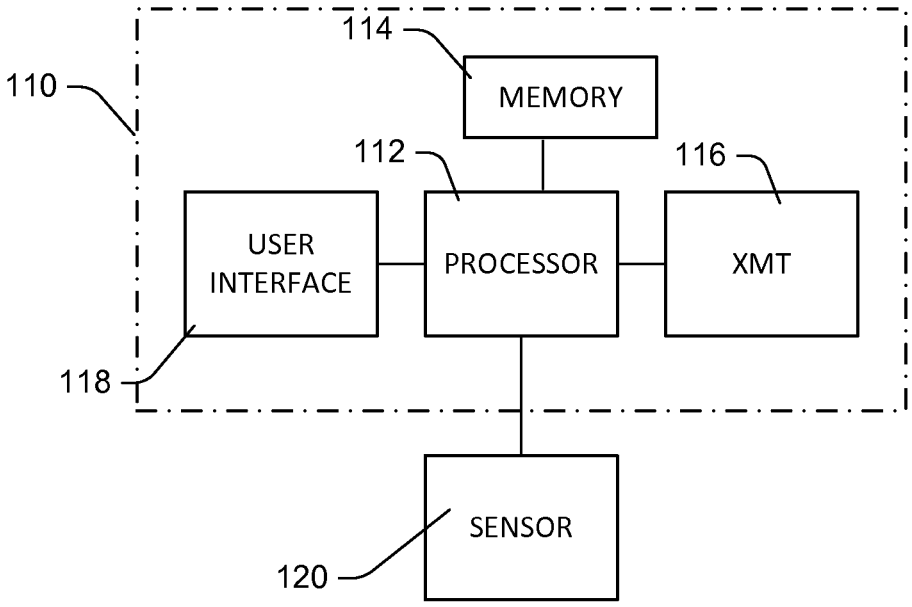
FIG. 2 is a block diagram illustrating example aspects of a control unit of the remote control system illustrated in FIG. 1.

In some instances, certain self-propelled machines such as trenchers, terrain levelers, stump grinders, mulching machines, etc. and/or implements driven by such machines are operated remotely. In certain applications such remote operation can enhance operator safety or allow an optimum vantage point for maneuvering the machine. FIG. 1 illustrates an example of a remote control system 100 in accordance with aspects of the present disclosure. The remote control system includes a control unit 110 that is configured to send a control signal 102 to a machine 10 from a position remote from the machine 10. In some embodiments, the machine 10 includes a ground drive for moving the machine 10 and an implement 11 that receives a control signal 102 from the control unit 110. In further embodiments, a plurality of machines may be controlled from a single control unit 110, or multiple control units 110 could be under the control of a single operator.

In some examples, the control unit includes an appropriately programmed processor 112 (microprocessor, microcontroller, application specific integrated circuit (ASIC), programmable logic device, etc.) configured to execute various processes for the remote control system 100. Some form of computer readable memory 114 typically stores program instructions for operating the control unit. Examples of computer-readable media include computer storage media and communication media. Computer storage media is physical media that is distinguished from communication media. Computer storage media includes physical volatile and nonvolatile, removable and non-removable media implemented in any method or technology for persistent storage of information, such as computer-readable instructions, data structures, program modules, or other data. Computer storage media also includes, but is not limited to, RAM, ROM, EEPROM, flash memory or other memory technology, CD-ROM, DVD or other optical storage, magnetic cassettes, magnetic tape, magnetic disk storage or other magnetic storage devices, or any other medium which can be used to persistently store desired information and which can be accessed by the processor. Any such computer storage media may be part of or external to the control unit 110.

Communication media is typically embodied by computer-readable instructions, data structures, program modules, or other data, in a modulated data signal, such as a carrier wave or other transport mechanism, and includes any information delivery media. The term "modulated data signal" means a signal that has one or more of its characteristics set or changed in such a manner as to encode information in the signal. By way of example, communication media includes wired media such as a wired network or direct-wired connection, and wireless media such as acoustic, RF, infrared and other wireless media.

The control unit further includes a user interface 118 that includes the controls necessary for operating the machine 10 from the remote control system 100. In some implementations, the user interface 118 replicates at least some of the controls found in the machine to be controlled.

A transmitter or transceiver 116 is connected to the processor and sends control signals to the machine 10 from the processor 112 in response to the user interface 118 and program instructions. In some embodiments, the system 110 also receives signals from the machine 10. The transmitter 116 sends (and receives) control signals via any suitable wired or wireless communication medium, such as radio frequency (RF), infrared (IR), etc.

The remote control system 100 includes a sensor system 120 that is configured to register a presence of an operator 12 in a predetermined proximity to a predetermined location. In FIG. 1, the broken line 14 indicates the predetermined location. To further increase the safety of an operator, for example, the predetermined position could be a position out of the path of travel of the machine 10. If the machine is, for example, operating near a high wall, drop off or mesa, the predetermined location 14 could be a position safely away from such terrain features.

For example, the sensor system 120 is configured in some embodiments for registering a presence of an operator 12 in the predetermined location 14, such as by directly determining the position of the operator 12 position using global positioning system (GPS) technology. In other examples, the position of the operator 12 is determined indirectly by verifying that the control unit 110 is located at the predetermined location, and the sensing system 120 is configured to register the presence of the operator 12 in a predetermined proximity to the control unit 110.

In addition to selecting a location 14 safely remote from the machine 10, the predetermined location includes an enclosure in some implementations. Insuring that the operator 12 is located in an enclosure that includes, for example, protection over and around the operator can increase the operator's safety when remotely operating the machine 10. Examples of suitable enclosures include building structures that have sides and a roof, such as a non-portable or portable building or the cab of a vehicle. Having the operator in an enclosed environment can help prevent the operator getting too close to a known structural hazard (drop-offs, trenches, digging chain, etc.). For example, an operator would probably be less likely to drive a truck up to an edge of a trench than to walk up to the edge of that same trench. Further, using the cab of a vehicle as the enclosure provides mobility for the operator to potentially maintain a desired vantage point while performing work with the controlled machine. The enclosure may also offer a level of protection against the risk of explosion or possible flying debris.

Figure 3:
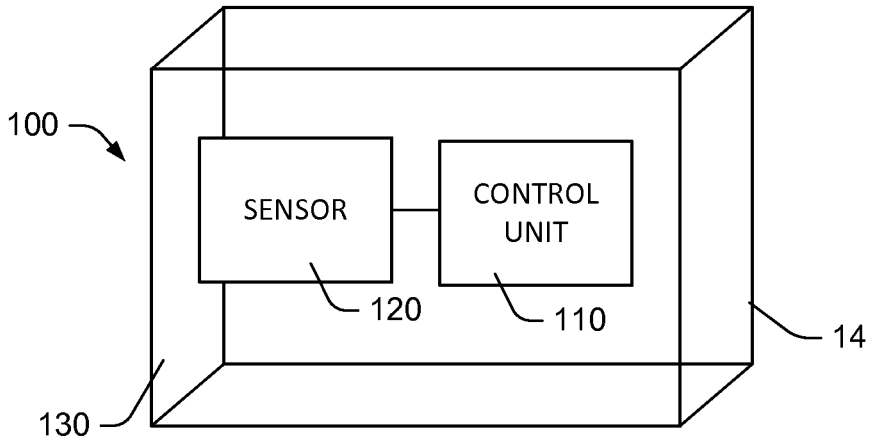
FIG. 3 is a block diagram conceptually illustrating the sensor and control unit of the remote control system of FIG. 1 situated in an enclosure.

FIG. 3 conceptually illustrates such an embodiment. In the embodiment illustrated in FIG. 3, the sensor 120 is operatively connected to the control unit 110 and is configured to register the presence of the control unit 110 in an enclosure 130. In some examples, the sensor 120 is further configured to register the presence of an operator inside the enclosure 130 and/or in a predetermined proximity to the control unit 110.

Various sensing technologies could be used for sensing the presence of the operator 12 in the predetermined location 14 and/or in the predetermined proximity to the control unit 110. In one example, the sensor 120 includes a pressure sensor that is configured to register the presence of the operator thereon. In various implementations, such a pressure sensor is configured to sense an operator sitting or standing thereon, for example. In other embodiments, other sensing technology is used. For example, capacitive sensing could be used to sense the presence of an operator in proximity to the control unit 110. A temperature sensor could be employed to sense the operator's body heat in the desired location. In other examples, a video camera with face recognition software may be situated near the control unit to verify the presence of a user. Other sensing technologies could be employed.

In still further embodiments, the control unit 110 must receive periodic input from an operator to verify the operator's presence near the control unit 110 and/or to verify the operator's active control of the machine. For example, the operator must periodically manipulate controls for operating the machine, or periodically activate a control provided for the sole purpose of registering the operator's presence at the control unit 110.

Figure 4:
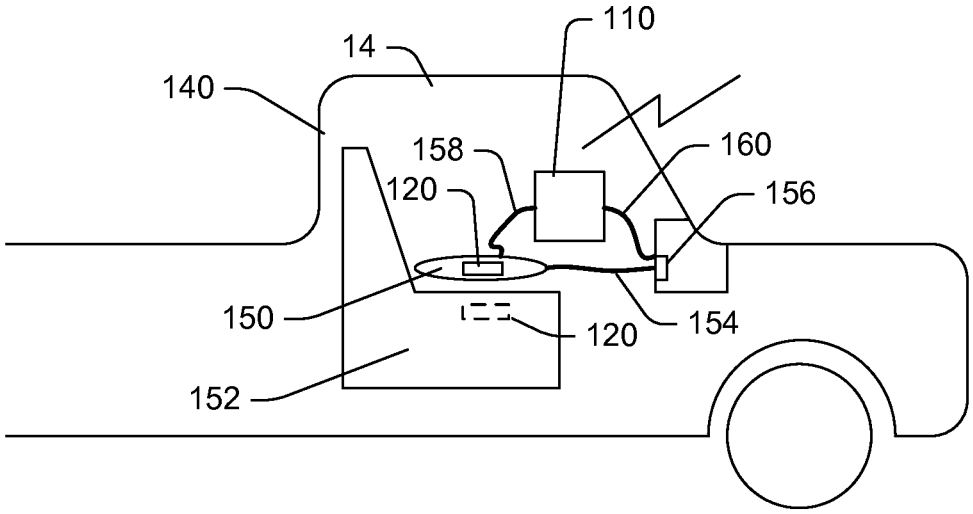
FIG. 4 is a block diagram illustrating an example of the remote control system of FIG. 1 wherein the predetermined location includes a vehicle.

FIG. 4 conceptually illustrates an embodiment of the remote control system 100 wherein the predetermined location is inside a vehicle 140. In the example illustrated in FIG. 4, the sensor 120 includes a pressure sensor incorporated into a portable seat cushion 150. The cushion 150 can be placed in any desired location within the enclosure (i.e., the vehicle in this embodiment) for confirming the location of the operator remotely operating the machine 10 using the control unit 110. Incorporating the sensor 120 into the portable seat cushion 150 facilitates a portable remote control system that can be moved from one suitable enclosure to another as desired. The control unit 110 receives a signal from the sensor 120 indicating the presence of the user thereon. The signal can be received via a sensor cable 156 connecting the sensor 120 to the control unit 110, for example.

As shown in FIG. 4, the seat cushion 120 is placed upon a vehicle seat 152 and attached via a power cord 154 to a power outlet 156 of the vehicle 140. The vehicle power outlet 156 is typically a 12 volt outlet connected to the 12 volt battery of the vehicle 140. In other embodiments, the power outlet 156 could be, by way of example, a 120 V or 240V AC wall outlet in an enclosure. Attaching the power cord 154 to the power outlet 156 verifies or registers the presence of the cushion 150 and sensor 120, and thus, by extension, an operator seated upon the cushion 150, in the predetermined location 14—which is inside the vehicle 140 in the illustrated embodiment. In some embodiments, the control unit 110 is also powered using the power outlet 156 of the vehicle 140 via a power cable 160. Alternatively, the control unit 110 could be powered via its own power source such as a battery, or it could receive power via the sensor cable 158. In further implementations, the power cable 154 could be eliminated and the control unit could be plugged into the power outlet 156 via the power cable 160. The sensor 120 could then be powered via the sensor cable 158, which also could register the presence of the user on the cushion 150. Still further arrangements are possible, such as sending an input signal from the sensor 120 to the control unit 110 via suitable wireless technologies, for example.

In alternative implementations, the sensor 120 is directly incorporated into the seat 152 of the vehicle 140 (as schematically illustrated in dashed lines in FIG. 4), rather than providing a portable seat cushion 150. The presence of the operator could be sensed and input to the control unit 110 in the manner described above in conjunction with the portable seat cushion 150.

In some embodiments, registering the presence of the user and/or the control unit 110 in the predetermined location 14, such as an enclosure or vehicle cab is required for full remote operation of the machine 10 and/or an implement 11 powered thereby. Thus, if the system 100 registers the presence of the operator in the predetermined location, the system 100 would be functional to operate the machine 10 and associated implements 11 with no unusual operational limitations. If the system 100 fails to register the operator's presence and/or periodic input, it could completely stop remote operations, or remote operation could be limited. Limited or restricted operations could include, for example, a "service" mode wherein any of the powered systems of the machine 10, including the implement 11, could be controlled by the control unit 110, but in a mode that is different than a full operational mode. In this mode the implement 11 might be allowed to operate in restricted speed, or in a jog mode, or some other type of restricted fashion and the ground drive of the machine 10 may be allowed to operate at a restricted speed. Another limited or restricted operation could be a "transport" mode wherein the ground drive system of the machine is operational, but the implement 11 is not operational.

For example, if no inputs are received by the control unit 110 from the operator 12 after a predetermined distance or elapsed time of travel of the machine 10, the machine and/or the implement thereof may be shut down. In one implementation, the predetermined distance of travel is in the approximate range of 4 to 10 meters (for example, 6 meters). In other embodiments, only limited remote operation of machine 10 is enabled depending on what inputs are received by control unit 110. In still further embodiments, the presence of the user and/or the control unit 110 in the predetermined location 14 is required for the control unit 110 to remotely operate an implement powered by the machine 10 at its intended-use capacity range. In this latter instance, if the user and/or the control unit were not suitably proximate the predetermined location 14, the user, for example, may be limited to operating the implement 11 at a level suitable for inspection and/or maintenance thereof but could still be free to maneuver the machine 10.

Figure 5:
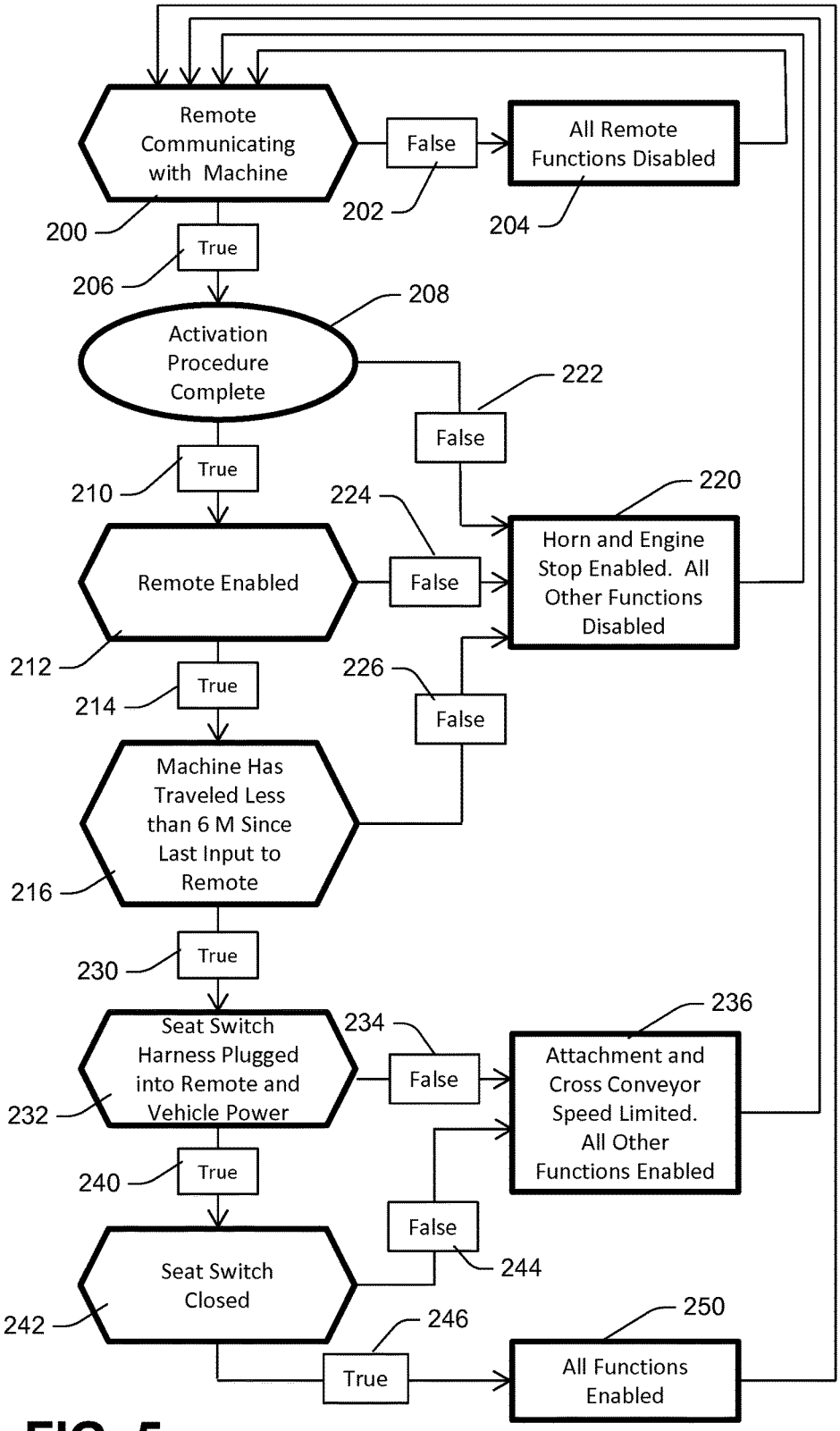
FIG. 5 is a flow diagram illustrating example operations of an embodiment of the remote control system illustrated in FIG. 4.

FIG. 5 is a flow diagram illustrating aspects of the remote control system 100 operation in accordance with some example implementations. At block 200, the system 100 determines whether the control unit 110 is communicated with the machine 10. If communication has not been established (block 202), all remote functions are disabled at block 204. If remote communication has been established (block 206), the system checks the status of the activation procedure at block 208. If the activation procedure is complete (block 210), the system checks for enablement of the remote at block 212. If the activation procedure is complete (block 214), the system checks the distance of machine travel since the last input received by the control unit 110 in block in 216. If any of the items checked in blocks 208, 212 and 216 are false as determined in blocks 222, 224 and 226, respectively, only limited functions of the machine 10 are enabled at block 220. In the illustrated embodiment, only the horn and engine stop functions of the machine 10 are enabled if any of the activation procedure 208, remote enabled 212 and machine travel distance 216 are false. All other functions of the machine 10 are disabled.

In the illustrated embodiment, the predetermined travel distance checked is 6 meters. In other words, if the machine 10 has traveled 6 meters or more without receiving an operator input by the control unit 110, all machine functions except horn and engine stop are disabled. In alternative implementations, other predetermined travel distances are evaluated. For example, the travel distance checked in block 216 could vary depending on the type of machine 10 being controlled. For very slow moving machines, for example, the travel distance may be set to a shorter distance. In some implementations, the travel distance is determined by monitoring the travel speed of the machine 10 and the travel time to calculate travel distance. In still further implementations, the travel time is evaluated in addition to, or in place of, the travel distance in block 216. In some examples, the machine functions are disabled if some predetermined time period such as 8 seconds has elapsed since receiving an operator input by the control unit 110. In other embodiments, movement of the implement 11 could be monitored in addition to or in place of travel distance of the machine 10.

If the variables checked in blocks 208, 212 and 216 are all true, then the system verifies that the sensor 120 and the operator are is located in the predetermined location 14. In the example shown in FIG. 5, this is accomplished by verifying that the sensor 120 incorporated into the seat cushion 150 is plugged into the remote control unit 110 and the power outlet 156 of the vehicle 140, and that the operator presence has been determined by the sensor 120. In some embodiments, the sensor cable 158 and the power cable 154 (or 160) are a predetermined length, which verifies that the sensor 120 and control unit 110 are located no more than the length of the cables from the predetermined location (inside the vehicle 140, for example). For example, in some implementations the power cable 154 and sensor cable 158 are each about 5 feet long. In other embodiments, only one or the other of the sensor 120 (cushion 150) and the control unit 110 are verified as being in the predetermined location at block 232.

If the sensor 120 is not plugged into the control unit 110 and/or the power outlet 156 (block 234), then operation of the controlled machine 10 is limited. In block 236, the attachment/implement 11 and cross conveyor functions of the machine 10 are speed limited, and all other functions of the machine 10 are enabled. If the sensor 120 is plugged into the control unit 110 and the power outlet 156 (block 240), then the system verifies that the sensor 120 has received an input indicating the active presence of the operator. In the system illustrated in FIG. 4, the sensor 120 is incorporated into either a portable seat cushion 150 or the seat 152 of the vehicle 140. In such implementations, the sensor 120 could include a pressure switch that closes when an operator sits on the cushion 150, 152. If the seat switch is not closed (block 244), then functions of the machine 10 (and/or the implement 11 associated therewith) are limited as indicated in block 236. If the seat switch is closed (block 246), the presence of the operator at the predetermined proximity to the predetermined location 14 is registered, and all functions of the machine 10 are enabled in block 250.

In some implementations using a seat switch as illustrated in FIG. 5, a delay is incorporated to allow movement or adjustment of the operator. For example, if the seat switch opens when an operator momentarily raises from the seat then closes again (the operator returns to a seated position) within some predetermined time period (3 seconds in some embodiments), functions of the machine are not limited as shown in block 236.

Other embodiments include an input switch on the control unit 110 configured for the sole purpose of registering the presence of the operator. For example, some controlled machines, such as a trencher, move slowly and during some operations require infrequent adjustments from an operator. For controlled machines such as these, the operator situated in the predetermined location 14 may be required to periodically activate a switch on the control unit 110 simply to indicate his or her presence at the control unit 110.

Still further implementations are envisioned wherein the system 100 is configured to detect a utility or dangerous obstruction (gas/power lines, high walls, certain terrain features, etc.) present in a predetermined proximity to the controlled machine. In such versions of the system 100, the machine 10 could be automatically stopped, and/or an alert/alarm could be activated in response to sensing an obstruction. An operator override could further be provided. Further, such predetermined obstruction and/or potential hazard locations could be indicated on a pre-programmed map, or could be sensed using any suitable sensing technology.

Various modifications and alterations of this disclosure may become apparent to those skilled in the art without departing from the scope and spirit of this disclosure, and it should be understood that the scope of this disclosure is not to be unduly limited to the illustrative examples set forth herein.

What is claimed is:

1. A remote control system, comprising:

a control unit configured to send a control signal to a machine to be controlled from a position remote from the machine, the machine being located at a machine position;

a sensor system operatively linked with the control unit, the sensor system being configured for registering a presence of an operator within a predetermined proximity of a predetermined operator position that is separate and remote from the machine position;

wherein if the sensor system registers the presence of the operator within the predetermined proximity of the predetermined operator position, sending the control signal from the control unit to the machine is fully enabled;

wherein if the sensor system does not register the presence of the operator within the predetermined proximity of the predetermined operator position, sending the control signal from the control unit to the machine is limited;

wherein the sensor system includes a pressure sensor located at the predetermined operator position, the pressure sensor being configured for registering the presence of the operator thereon;

wherein the pressure sensor is one of separately and integrally associated with a seat of a vehicle located at the predetermined operator position; and wherein the pressure sensor is connected to the control unit with a wire of a predetermined length to verify that the operator is within the predetermined length of the predetermined operator position.

2. The remote control system of claim 1, wherein the sensor system is configured for registering a presence of the operator within a predetermined proximity of the control unit.

3. The remote control system of claim 1, wherein the sensor system is configured to register the presence of the operator in the predetermined operator position.

4. The remote control system of claim 1, wherein the machine includes an implement, and wherein the registered presence of the operator within the predetermined proximity of the predetermined operator position is required for the control unit to be able to be used to operate the implement at a predetermined level of operation.

5. The remote control system of claim 1, wherein operation of the machine is disabled in response to the sensor system failing to register the presence of the operator within the predetermined proximity of the predetermined operator position.

6. The remote-control system of claim 1, wherein the pressure sensor is located within a portable seat cushion.

7. The remote control system of claim 1, wherein the sensor system includes a power cord having a plug end configured for electrical connection with a power port, wherein the sensor system is configured for registering a presence of the control unit in the predetermined operator position in response to the plug end being connected to a power port located at the predetermined operator position.

8. The remote control system of claim 1, further comprising an enclosure located at the predetermined operator position, and wherein the sensor system is configured to register the presence of at least one of the operator and the control unit within the enclosure.

9. The remote control system of claim 8, wherein the enclosure includes a vehicle.

10. The remote control system of claim 1, wherein the machine includes an implement powered by the machine, and wherein the control unit is configured to send a control signal to the implement from the predetermined operator position in response to the sensor system.

11. The remote control system of claim 1, wherein the sensor system is configured to register the presence of the operator within the predetermined proximity of the predetermined operator position by receiving a periodic input of the operator.

12. The remote control system of claim 11, wherein the control unit is configured so as to auto-shutdown the machine after a predefined distance of travel of the machine without the control unit receiving the periodic input of the operator.

13. The remote control system of claim 12, wherein the predefined distance of travel is approximately six meters.

14. The remote control system of claim 1, wherein the sensor system includes a camera and image analysis to evaluate an image to verify that the operator is within the predetermined proximity of the predetermined operator position.

15. A remote control system, comprising:

a control unit configured to send a control signal to a machine to be controlled from a position remote from the machine, the machine being located at a machine position;

an enclosure located at a predetermined operator position that is separate and remote from the machine position;

a sensor system operatively linked with the control unit, the sensor system being configured for registering a presence of at least one of an operator and the control unit within the enclosure, wherein operation of the machine by the control unit is limited in response to the sensor system;

wherein the sensor system includes a pressure sensor located at the predetermined operator position, the pressure sensor being configured for registering the presence of the operator thereon;

wherein the pressure sensor is one of separately and integrally associated with a seat of a vehicle located at the predetermined operator position; and wherein the pressure sensor is connected to the control unit with a wire of a predetermined length to verify that the operator is within the predetermined length of the predetermined operator position.

16. The remote control system of claim 15, wherein the sensor system is configured for registering a presence of the operator within a predetermined proximity to the control unit.

17. A method of remotely operating a machine located at a machine position, comprising:

identifying a predetermined operator position that is separate and remote from the machine position;

sensing the presence of a control unit at the predetermined operator position;

sensing the presence of an operator within a predetermined proximity of the predetermined operator position; and based thereon: enabling a control unit to send a control signal to the machine in response to registering the presence of the operator within the predetermined proximity of the predetermined operator position; and disabling the control unit from sending the control signal to the machine in response to not registering the presence of the operator within the predetermined proximity of the predetermined operator position;

wherein a sensor system to sense the presence of the operator includes a pressure sensor located at the predetermined operator position, the pressure sensor being configured for registering the presence of the operator thereon;

wherein the pressure sensor is one of separately and integrally associated with a seat of a vehicle located at the predetermined operator position; and wherein the pressure sensor is connected to the control unit with a wire of a predetermined length to verify that the operator is within the predetermined length of the predetermined operator position.

* * * * *